United States Patent [19]

Judge

[11] Patent Number: 4,817,826

[45] **Date of Patent: * Apr. 4, 1989**

[54] TOOTHBRUSH HOLDER FOR STAND-UP TOOTHPASTE DISPENSERS

[76] Inventor: Joseph Judge, 1660 E. 12th St., Brooklyn, N.Y. 11229

[ * ] Notice: The portion of the term of this patent subsequent to Nov. 10, 2004 has been disclaimed.

[21] Appl. No.: 93,617

[22] Filed: Sep. 8, 1987

Related U.S. Application Data

[63] Continuation-in-part of Ser. No. 941,068, Dec. 12, 1986, Pat. No. 4,705,194.

[51] Int. Cl.[4] ..... A47G 29/08; B67D 5/06

[52] U.S. Cl. ..... 222/192; 206/277; 206/581; 206/370; 206/362.1; 211/65; 222/93; 248/110

[58] Field of Search ..... 222/93, 94, 105, 106, 222/173, 180, 129, 130, 143, 383, 340, 530, 538, 539, 566, 567, 569, 570, 192, 207, 209, 391, 386; 206/277, 581, 229, 370, 362.1, 362.2, 15.2, 15.3; 220/85 H; 215/100 R; 248/108–111, 230, 360, 312, 314, 315, 311.2, 316.1, 316.2; 211/65, 66; 132/79 B, 79 R, 80 R, 84 D, 84 R; D 6/526–534

[56] References Cited

U.S. PATENT DOCUMENTS

| | | | |
|---|---|---|---|
| 971,818 | 10/1910 | Barker | 222/93 |
| 1,005,985 | 10/1911 | Lebherz | 211/65 X |
| 1,951,831 | 3/1934 | Lewis | 206/277 |
| 1,958,022 | 5/1934 | Sheppard | 132/84 R |
| 2,082,834 | 6/1937 | Hofmann | 132/84 D |
| 2,906,479 | 9/1959 | Strachan | 211/65 X |
| 2,937,790 | 5/1960 | Lapeyre | 222/94 |
| 3,155,279 | 11/1964 | Ferguson, Jr. | 222/93 |
| 3,275,195 | 9/1966 | Reinstra | 222/105 X |
| 3,486,630 | 12/1969 | Ellman | 206/228 X |
| 3,586,212 | 6/1971 | Tzouras | 222/93 |
| 3,880,281 | 4/1975 | Taddei | 132/84 R X |
| 4,020,975 | 5/1977 | Stauffer | 222/105 X |
| 4,402,431 | 9/1983 | Wiegner et al. | 222/383 X |
| 4,437,591 | 3/1984 | von Schuckmann | 222/391 |
| 4,508,303 | 4/1985 | Beckerer, Jr. | 248/311.2 |
| 4,673,106 | 6/1987 | Fishman | 222/192 X |
| 4,705,194 | 11/1987 | Judge | 222/93 X |
| 4,776,492 | 10/1988 | Gallo | 222/192 X |

FOREIGN PATENT DOCUMENTS

| | | | |
|---|---|---|---|
| 637900 | 1/1964 | Belgium | 206/229 |

OTHER PUBLICATIONS

"Minigrip" Brochure, Packaging, 12/86, vol. 31, No. 13, p. 79.

*Primary Examiner*—Kevin P. Shaver
*Attorney, Agent, or Firm*—Low & Low

[57] ABSTRACT

A toothbrush holder attachment for stand-up toothpaste dispensers which is readily fabricated from thin sheet material, and which may be carried by the dispenser ready for use in the usual dispenser merchandizing carton. Toothbrushes may also be packaged therewith. The attachment is characterized by having an effective width substantially that of the stand-up base of such dispenser so as to be mounted thereon prior to packaging of the dispenser in the usual rectangular merchandizing carton, wherein the attachment assists in stabilizing the dispenser in its carton, and also permits the prepackaging therewith of a toothbrush carried by the mounted attachment.

6 Claims, 1 Drawing Sheet

TOOTHBRUSH HOLDER FOR STAND-UP TOOTHPASTE DISPENSERS

CROSS-REFERENCE TO RELATED APPLICATION

This application is a continuation-in-part of my pending application Ser. No. 941,068 filed Dec. 12, 1986 for Toothbrush Holder Attachment for Toothpaste Tubes now U.S. Pat. No. 4,705,194, granted Nov. 10, 1987.

BACKGROUND OF THE INVENTION

For years efforts have been made to readily associate a holder for toothbrushes with diverse toothpaste tube structures, whether of the ordinary collapsible tube type or other forms thereof.

In recent years, a new form of toothpaste dispenser has been widely marketed characterized by a wide circular base permitting a toothpaste dispenser to stand erect on a shelf and from which toothpaste may be dispensed by pump or pressure action. Illustrative of such stand-up toothpaste dispensers is U.S. Pat. No. 4,402,431 to Wiegner et al., among others.

My prior application Ser. No. 941,068 filed Dec. 12, 1986 shows one illustrative and advantageous form of attachment for such stand-up tubes to facilitate utility by the consumer.

BRIEF SUMMARY OF THE INVENTION

The present invention improves thereupon in providing a toothbrush holding attachment for a stand-up dispenser which is economically manufactured, readily marketed with existing toothpaste dispensers without alteration of the packaging carton, permits simultaneous marketing of one or more toothbrushes in the same carton, and indeed enhances utility and sanitary conditions by having a substantially permanent but readily detachable mount upon the neck of the toothpaste dispenser.

To this end, the improved attachment herein comprises a thin sheet of relatively rigid material, as readily available sheet plastic material such as polystyrene or polyethylene, or thin metal, which are quite inexpensive and easily fabricated.

The attachment sheet is so configured so as to readily fit within the lateral dimensions of existing merchandising carton stock and is apertured to provide support means for one or more toothbrushes associated with the holder attachment as mounted on the toothpaste dispenser.

Further, the supports for the toothbrushes are so positioned that the brushes themselves may be carried by the attachment within the original merchandising carton of the toothpaste dispenser proper.

The relatively rigid yet somewhat flexible holder sheet is centrally apertured and configured to provide thread-engaging means thereon whereby the attachment may be readily manually or machine-screwed onto the conventional threaded neck of a toothpaste tube or dispenser and may be retained thereon with the cap of the toothpaste dispenser normally secured on the neck. In this manner, sanitary handling of the toothpaste dispenser is enhanced whereby it is unnecessary to manipulate or remove the toothbrush holding attachment unless desired.

DESCRIPTION OF THE PREFERRED EMBODIMENT

Figure 1:
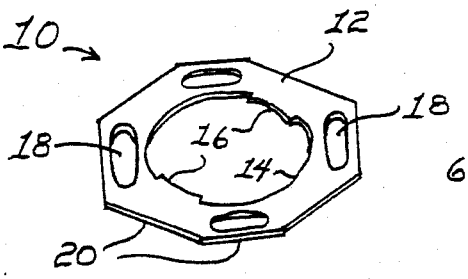
FIG. 1 is a perspective view of the toothbrush holder attachment prior to association with a dispenser or one or more toothbrushes.

The toothbrush holding attachment of the subject invention is seen in FIG. 1 at 10 and includes an apertured sheet of relatively rigid material 12 which may be of thin plastic, thin metal or indeed even appropriately coated or waterproofed paper stock or laminate if desired.

The holder 12 is centrally apertured at 14 and is provided with appropriately configured inwardly extending thread flanges at 16 whereby the attachment may readily be threadedly engaged with the conventional external threads 30 provided on the dispensing head 32 of a stand-up toothpaste dispenser 34, and seat upon a shoulder 40 of the dispenser at the wider tubular portion thereof.

The attachment 10 may be of any desired peripherial configuration, but is preferably of generally octagonal configuration as shown, although the same may readily be circular or square or other shape if desired. The octagonal configuration shown has the advantage of minimizing usage of material to fabricate the same as well as eliminating 90 degree sharp corners of the holder which might inconvenience the user to impede ready packaging of the holder within the usual merchandising carton 50.

At a plurality of peripheral points on the holder, apertures 18 are provided of a suitable size and configuration as is well known in the art to permit a toothbrush 60 to be slipped therethrough and supported with the upper portion of the toothbrush 62 with the bristles thereat engaging the upper surface of the holder 10 with the handle of the toothbrush depending therethrough.

In the configuration shown, four such apertures 18 are provided which would permit the stand-up dispenser to conveniently support up to four toothbrushes for ready usage by members of a family.

Figure 2:
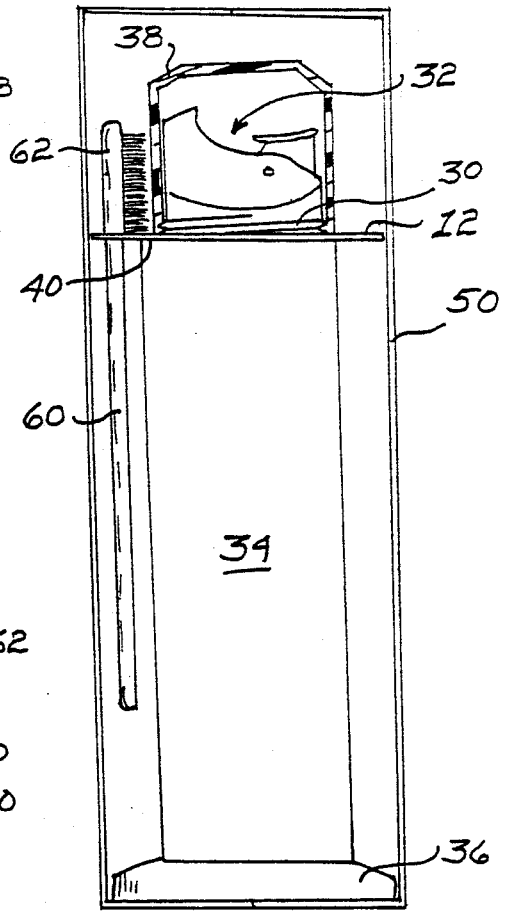
FIG. 2 is a side elevation, partly in section, of the attachment as associated with a stand-up toothpaste dispenser as packaged within an ordinary commercial merchandising carton, further showing a toothbrush associated therewith; and, FIG. 3 is a top plan view of the holder mounted on a toothpaste dispenser within a carton, certain parts being removed for clarity.
Figure 3:
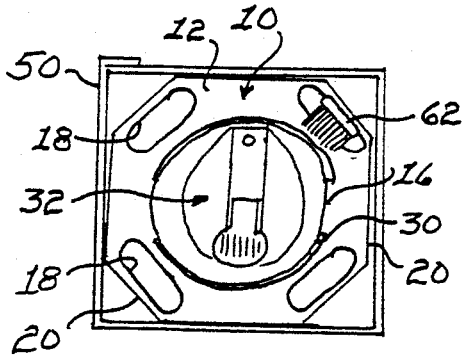

Further, the attachment 12 is so configured as to have its lateral peripheral edges 20 so dimensioned as to readily fit within the merchandising carton 50 as seen in FIGS. 2 & 3. This is readily effected inasmuch as the base 36 of the conventional stand-up dispenser has an area in excess of that of the tubular container proper thereby requiring a carton 50 of at least sufficient lateral dimensions to accommodate the container base 36. In so doing, space exists between the container and the wall of the carton in the neck area 30 of the dispenser whereby the attachment 12 may be readily threadedly secured onto the dispenser 34 at the time of manufacture and easily retained thereon by means of the usual threaded cap 38. Indeed, as seen in the drawings, the mounting of the attachment 10 on the dispenser 34 further serves to stabilize the dispenser in the carton without undue lateral movement thereof.

It will be seen then, that the attachment 12 may be merchandised with the dispenser 34 in the carton 50 ready to use. In like manner, if desired, one or more toothbrushes 60 may be simultaneously packaged in the carton 50 and carried by the attachment 12. Accordingly, upon opening the carton 50, the consumer may withdraw the dispenser and the attachment 10 carried thereon with one or more toothbrushes 60 for convenient and immediate use.

Obviously, if desired, as the lateral edges 20 of the attachment 10 are so dimensioned as to have no greater width than the interior dimensions of the carton 50 and preferably not significantly greater than the diameter of the base of the dispenser at 36, the attachment may be loosely packaged within the carton 50 by simply dropping the same down to one side of the dispenser adjacent a wall of carton 50, if it is not desired to threadedly assemble the attachment onto the dispenser before packaging.

Accordingly, it will be seen that the subject attachment is markedly simple and effective in manufacture and use, with reliable, inexpensive fabrication from readily available materials and associated packaging with stand-up dispensers without alteration of present merchandising cartons or packaging techniques.

What I claim is:

1. A toothpaste dispenser package comprising in cooperative association, a stand-up toothpaste dispenser having a tubular body, a supporting base therefor extending laterally beyond the tubular body, and an upstanding neck of lesser diameter than said body, a merchandising carton for said dispenser having a cross-sectional internal dimension at least as great as said dispenser base, whereby surrounding space exists between the walls of said carton and said dispenser body and neck, a toothbrush holder attachment of relatively stiff thin sheet material having a central aperture for reception therethrough of said dispenser neck, said attachment having means at said aperture for cooperatively engaging said neck to retain said attachment thereon, said attachment further having laterally extending portions of substantially the lateral extent of said dispenser base and of said carton internal dimension, and having at least one smaller aperture in said portions for reception of a toothbrush, said attachment thereby having a dimensional configuration to fit within said carton substantially normal to the longitudinal axis thereof so as to be enabled to be inserted into said carton assembled onto said dispenser neck and fit within said surrounding space, whereby said dispenser base and said attachment at the dispenser neck cooperate to stabilize the dispenser within the carton notwithstanding the smaller dimension of the said dispenser body.

2. The structure of claim 1, wherein said attachment is fabricated from plastic material.

3. The attachment of claim 1 wherein said attachment is fabricated from thin sheet metal.

4. The attachment of claim 1 wherein the attachment is fabricated from waterproof fibrous stock.

5. The attachment of claim 1 wherein the periphery thereof is substantially octagonal to minimize sharp corners and maximize surface area for rigidifying the attachment.

6. The package of claim 1 further including a toothbrush in said package.

* * * * *